US007278753B2

(12) United States Patent
Uke

(10) Patent No.: US 7,278,753 B2
(45) **Date of Patent: *Oct. 9, 2007**

(54) FLASHLIGHT WITH DROP-IN SIDE-BY-SIDE BATTERIES

(76) Inventor: Alan K. Uke, 355 14th St., Del Mar, CA (US) 92014

( * ) Notice: Subject to any disclaimer, the term of this patent is extended or adjusted under 35 U.S.C. 154(b) by 0 days.

This patent is subject to a terminal disclaimer.

(21) Appl. No.: 11/249,811

(22) Filed: Oct. 13, 2005

(65) Prior Publication Data

US 2006/0034073 A1 Feb. 16, 2006

Related U.S. Application Data

(62) Division of application No. 10/638,123, filed on Aug. 8, 2003, now Pat. No. 6,955,446.

(51) Int. Cl.
*F21L 4/00* (2006.01)

(52) U.S. Cl. ..... 362/206; 362/203; 362/157; 362/253; 439/1; 439/261; 439/338; 439/341; 439/500

(58) Field of Classification Search ..... 362/201, 362/203, 95, 157, 202, 206, 362, 253, 547, 362/458; 439/341, 247, 261, 500, 246, 248, 439/252, 259, 338, 1; 429/1
See application file for complete search history.

(56) References Cited

U.S. PATENT DOCUMENTS 3,662,166 A 5/1972 Dietz
3,794,825 A 2/1974 Krupansky
3,863,062 A 1/1975 Caron
3,881,961 A 5/1975 Nation
3,979,228 A 9/1976 Marchetti
4,129,688 A 12/1978 Fischer
4,644,451 A 2/1987 Chabria
4,690,878 A * 9/1987 Nakamura ..... 429/1
4,709,309 A 11/1987 Yamaki
4,774,644 A 9/1988 Ohashi
4,870,550 A 9/1989 Uke
4,965,141 A * 10/1990 Suzuki ..... 429/9
4,985,812 A 1/1991 Uke
5,007,859 A * 4/1991 Sangregory et al. ..... 439/500
5,431,575 A * 7/1995 Engira ..... 439/218
5,558,430 A 9/1996 Booty, Jr.
5,567,545 A * 10/1996 Murakami ..... 429/163
5,895,112 A 4/1999 Olivit et al.
5,904,414 A 5/1999 Monteleone et al.
5,971,560 A * 10/1999 Chen ..... 362/119
6,224,228 B1 * 5/2001 Frederick ..... 362/116
6,338,914 B1 * 1/2002 Schuurmans ..... 429/97
6,523,972 B2 2/2003 Sharrah et al.
6,783,390 B2 * 8/2004 Berg et al. ..... 439/500
6,825,427 B2 * 11/2004 Jenks ..... 200/51.12

* cited by examiner

*Primary Examiner*—Jong-Suk (James) Lee
*Assistant Examiner*—Jacob Y Choi
(74) *Attorney, Agent, or Firm*—Foley & Lardner, LLP

(57) ABSTRACT

A battery powered flashlight is described that has a pivot contact with an off-center pivot point and/or battery polarization is described. The flashlight is configured to allow batteries to be dropped into place without interference with internal flashlight components.

14 Claims, 3 Drawing Sheets

FLASHLIGHT WITH DROP-IN SIDE-BY-SIDE BATTERIES

CROSS-REFERENCE TO RELATED PATENT APPLICATIONS

{ENTER Not applicable or related application information.}

BACKGROUND OF THE INVENTION

The present invention relates to the field of battery powered flashlights, and especially to flashlights suitable for use in highly flammable or explosive environments.

The information provided herein and references cited is intended soley to assist the understanding of the reader. None of the information provided or references cited is admitted to be prior art to the present invention.

A large number of different flashlight designs have been described with various configurations. Most flashlights have generally cylindrical hollow housings that contain one or more cylindrical batteries in a single row. When a plurality of batteries are used, the positive terminal of the battery most distal from the light source contacts the negative terminal of the adjacent battery, continuing in this manner so that the positive terminal of the battery nearest the light source connnects with the light source. However, not all flashlights use the linear battery arrangement.

U.S. Pat. No. 5,904,414 describes a flashlight with a gas permeable membrane and battery polarization. One of the flashlights described has a side-by-side battery configuration with 2 batteries in each row, and uses a connector plate with springs behind it at the rear of the flashlight to electrically connect the two rows of batteries.

Underwater Kinetics markets a flashlight (UK2AAA) that has two AAA batteries in a side-by-side configuration. A contact plate that pivots on a central transverse hinge pin at the back of the flashlight provides contact between the batteries. A screw-on bezel causes the electrical circuit to be completed.

SUMMARY OF THE INVENTION

The present invention concerns a flashlight that uses batteries in a side-by-side arrangement where the batteries can be inserted in a simple drop-in manner and where the flashlight includes features that allow more convenient battery insertion and/or provide battery polarization. Configurations that include the feature allowing more convenient battery insertion thus avoid the difficulties involved in inserting and removing batteries when spring compression or the like is needed to place and/or hold the batteries in proper position. This is accomplished by using a pivoting electrical connector that has an off-set pivot point. That pivoting connector, termed a pivot contact, is located at the rear of the battery chamber in the flashligh housing, and provides an electrical connection between two side-by-side rows of batteries. The off-set pivot provides a lever with unequal length lever arms, so that pressing a row of batteries against the short arm of the pivoting connector (such as by screwing on a bezel containing a reflector assembly with a light bulb) causes movement of the short arm and a corresponding a larger movement of the longer arm. Using this construction, the pivoting connector can pivot out of the way to allow an initial row of batteries to drop into place in line with the longer arm of the connector without interference, but still allow positive contact to be made when the flashlight is closed. In configurations that include battery polarization, electrical contacts within the flashlight are designed such that an electrical path to energize a light source will only occur if the batteries are inserted with correct polarity. Such polarization can be used together with a pivot having on off-center pivot contact or separately.

Thus, the invention provides a flashlight that includes a battery housing that has a front end and a rear end. The housing is configured to accept a plurality of batteries in a side-by-side configuration, such that there are adjacent first and second rows of batteries. The flashlight also includes a light source assembly at the front end, electrical connections for providing electrical power from the batteries to a light source in the light source assembly, and a pivot contact at the inside of the rear end of the housing. The pivot contact provides an electrical connection between a battery in the first row and a battery in the second row. The pivot contact incudes a support or back plate that has an off-center pivot point and an electrically conductive material configured to provide an electrical path between the adjacent first and second rows of batteries.

Likewise, the invention provides a flashlight that includes a battery housing that has a front end and a rear end, where the housing is configured to accept a plurality of batteries in a side-by-side configuration such that there are adjacent first and second rows of batteries, a light source assembly at the front end, electrical connections for providing electrical power from the batteries to a light source in the light source assembly, and a pivot contact at the rear end providing an electrical connection between a battery in the first row to a battery in the second row. The connector includes a support with a pivot and a conductive material configured to provide an electrical path between said adjacent rows of batteries. The flashlight is configured to provide battery polarization such that only if the batteries are inserted with correct polarity will an electrical circuit be established to energize the light source.

In particular embodiments, the housing includes an opening at the front end aligned with the second battery row for insertion of the batteries, and the pivot contact has a short side (short term) oriented for contact with the second battery row; the pivot contact also includes a coil spring on the short side, with the spring oriented toward the opening; the pivot contact also includes polarizing contacts at the spring.

Also in particular embodiments, the flashlight also includes both an off-center pivot contact and a battery polarizer, such that only if the batteries are inserted with correct polarization will an electrical circuit be established to energize a light source in the light source assembly; the flashlight includes a gas vent allowing venting of gases from the housing; the flashlight is adapted for use in hazardous environments; the flashlight is waterproof; the flashlight passes the UL 30 foot drop test; a bezel containing the light source assembly is threaded to the housing at the opening; threading a bezel on the housing with batteries in the housing establishes electrical contact at the pivot contact and at the ends of the rows of batteries distal from the pivot contact; threading on a bezel at the opening of the housing also engages an O-ring seal on the housing; the housing is configured to accept 4 cylindrical batteries with two batteries in each of said rows (for example, AAA, AA, C, or D cells); the housing is configured to accept 6 cylindrical batteries with 3 in each row; the housing is configured to accept 2 cylindrical batteries with 1 in each row; the pivot contact has a curved pivot surface on the back of the contact;

the pivot contact presses against the inside of the rear end of the housing when the flashlight is closed with batteries in place.

In particular embodiments, the flashlight includes a 2-position switch; switching is performed by screwing on the bezel with the light source assembly; a gas vent for the housing is included that includes a gas-permeable/water impermeable membrane; a gas permeable/water impermeable membrane in a gas vent is a para trifluoroethylene (PTFE) membrane; a polarizing eyelet is included that is soldered to a coil spring of a pivot contact; the battery housing includes a main battery housing and an end cap; the end cap is welded to the main housing; there are 2 opposing cavities in the inside sides of the main housing adapted to accept retention pins of a pivot contact; there are two opposing cavities in the inside sides of the end cap adapted to accept retention pins of a pivot contact; installation of the end cap to the main housing causes a previously placed pivot contact to be retained in the housing; the center of the pivot of the center pivot is displaced at least 1 mm, 2 mm, 3 mm, 4 mm, 5 mm, 6 mm, or more from the center point of the pivot plate as measured from the center line between the center points of the battery contacts on each arm of the pivot contact.

As used herein, the term "battery housing" refers to a flashlight component that contains the batteries, with an opening for inserting the batteries, which is preferably the same opening at which the reflector assembly is attached to the housing.

In the context of the present invention, the term "battery polarizer" refers to a component or combination of components in a battery powered device, such as a flashlight, that prevents the device from being energized by the batteries unless the batteries are inserted with correct polarity. Generally, the components are configured such that electrical contact will not be established unless the adjacent battery is inserted with correct polarity.

For flashlights of this invention, the terms "front end" and "rear end" are defined with reference to the reflector assembly end of the flashlight. The end where the reflector assembly is attached is the front end, and the opposite end is the rear end or, equivalently, back end.

The term "light source" refers to a component that generate light when electrically energized, e.g., by battery. Such light sources include, for example, light emitting diodes (LEDs), light bulbs, and the like.

The term "light source assembly" refers to an assembly that includes a fitting for a light source or an integrated light source. Generally for the present invention such assemblies are configured to retain the light source in the flashlight. An assembly can include components such as a socket or fitting for a light source, a reflector to direct light out of the flashligh, one or more lenses to direct light out of the flashlight and/or to protech the light source and/or reflector, electrical contacts to electrically couple an adjacent battery to the assembly, and the like.

The term "reflector" is used as is conventional for battery-powered flashlights, to refer to a component(s) for reflecting light from the bulb or other light source forward out of the flashlight. Such an assembly can also include the light source. Typically a flashlight also includes a lens covering and protecting the reflector and light source from external contact.

As used herein, the term "conductive material" refers to electrically conductive material, e.g., a metal such as copper, brass, bronze, aluminum, a steel, and the like.

As used in the context of an opening for inserting batteries and a battery row, the term "substantially aligned" indicates that the referenced components are sufficiently aligned that batteries can be inserted through the opening without binding on other batteries and/or other portions of the flashlight, and such that electrical connection can be obtained between a light source assembly attached at the opening and the adjacent battery that is substantially aligned with the opening. In many cases, the longitudinal axis of the battery row and the center of the opening will be aligned within 1, 2, 3, 4, or 5 mm of the longitudinal axis, although greater off-sets can also be designed.

In a related aspect the invention provides a flashlight that includes a battery housing that has a front end and a rear end, where the housing is configured to accept a plurality of batteries in a side-by-side configuration, such that there are adjacent first and second rows of batteries, and where the housing has an opening at the front end aligned with second row for allowing insertion of the batteries; a bezel containing a light source assembly attached at the front end at the opening; electrical connections for providing electrical power from the batteries to a light source in the light source assembly; a pivot contact at the rear end providing an electrical connection between a battery in the first row to a battery in the second row, where the pivot contact includes a support with an off-center pivot defining a long arm and a short arm with the short arm aligned with the opening, a conductive material configured to provide an electrical path between the adjacent rows of batteries, where the conductive material includes a coil spring on the short arm oriented toward the opening; and a battery polarizer that allows a light source in the light source assembly to be energized only if the batteries are inserted with correct polarity.

In particular embodiments, the battery polarizer includes an electrically conductive ring attached to the spring, such that the ring provides contact with the negative terminal of an adjacent battery, and a plug in the interior of the ring that prevents electrical contact with the positive terminal of an adjacent battery; the pivot contact has a front side and a back side, and the back side includes a curved pivot surface; the flashlight also includes a gas vent; the flashlight passes the UL 30 ft drop test; the flashlight is UL Class I, Div I certified.

In another aspect, the invention more generally provides a battery-powered electrical device that provides convenient battery insertion and removal by utilizing a pivot contact with off-center pivot point as described herein, and can also include battery polarization. The device is configured to accept a plurality of batteries in a side-by-side configuration. The device is configured such that following battery insertion, the row of battery contacting the short arm of the pivot contact is compressed, actuating the pivot contact such that the lever action of the contact forces the other row of batteries into electrical contact at each end of the row and at intermediate contacts between batteries in the row, if any. For example, closure of the battery housing, case, or cavity can be closed with a threaded closure or a snap-fit closure to create the displacement of the battery row actuating the pivot contact. Examples of such devices can include flashlights; toy cars or other toy vehicles; radios, CD players, DVD players, MP3 players video cameras, and other such sound and/or video reproduction and/or recording devices; still cameras; and photographic flash units.

The invention also provides a pivot contact for an electrical device configured to accept a plurality of batteries in a side-by-side configuration, e.g., a flashlight, where the pivot contact includes a plate that has a front and a back surface, an off-center pivot defining a short arm and a long arm in the plate, and a conductive material providing an electrical path from the front surface of said short arm to the front surface of said long arm In particular embodiments, the pivot incudes a curved portion of the back surface of the plate; at least a portion of the back surface not including the pivot is configured to rest against an interior surface of the flashlight when batteries are installed; the conductive material includes a coil spring extending from the front surface of said short arm; the pivot contact also includes a battery polarizer, such as a polarizer that includes a conductive ring for contacting a negative terminal of a battery, and a non-conductive plug in the center of said ring for preventing electrical contact with the positive terminal of a battery; the conductive material provides an electrical path from the front surface of the short arm to the front surface of the long arm and includes an arm extending transversely from the spring.

A related aspect concerns a battery polarizer for use in an electrical device such as a flashlight that is configured to accept a plurality of batteries. The polarizer includes a an electrically conductive ring in contact with a coil spring. Inside the conductive ring is a non-conductive central plug, configured such that if a standard cylindrical battery (e.g., AAA, AA, C, or D cell battery) for which the electrical device is designed is placed against the battery polarizer such that an end of the battery is against the polarizer, an electrical path will be established if the negative terminal is against the polarizer, but not if the positive terminal is against the polarizer. The central non-conductive plug holds the positive terminal end of the battery away from the conductive ring. Advantageously, the battery polarizer can be constructed as part of a pivot contact as described above.

In yet another related aspect, the invention provides a method for providing battery polarization in a battery-peered electrical device by utilizing a battery polarizer as described herein in the electrical device. As indicated above, the battery polarizer can be constructed as part of a pivot contact as described above, thereby providing both ease of battery insertion and battery polarization in a device.

Additional aspects and embodiments will be apparent from the following Detailed Description and from the claims.

DETAILED DESCRIPTION OF THE PREFERRED EMBODIMENTS

Figure 1:
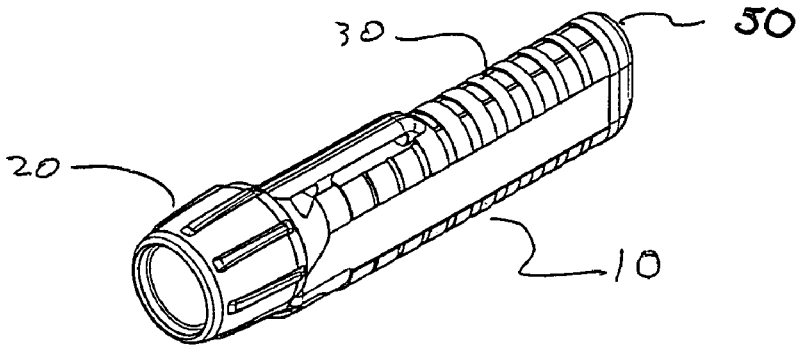
FIG. 1 is a perspective view of an exemplary flashlight of the present invention.

The present invention provides a flashlight that utlizes a side-by-side battery configuration in which the batteries are easily inserted and removed and/or that includes battery polarization. The ease with which the batteries are inserted and removed is due to the design of a pivoting contact piece (pivot contact) located in the rear of the battery housing. Alternatively, or in addition, the flashlight can be constructed to provide battery polarization, such that an electrical circuit will not be established unless the batteries are inserted in the flashlight with correct polarity, i.e., with correct orientation of positive and negative terminals. In addition, the flashlight can be constucted such that the flashlight is well-adapted for use in hazardous environments and further can be made waterproof.

A number of features can provide the adaptations for use in hazardous environments. These can, for example, include battery polarization. It is also beneficial to provide gas venting for the battery housing, so that gas pressure does not build up inside the housing. In addition, light bulbs can be selected that pose a low risk of causing ignition of environmental gases or other flammable or explosive materials. The flashlight as a whole can be constructed to have high impact resistance, and/or to be waterproof.

Battery Housing

As is generally understood, battery housings for flashlights can be formed of a variety of different materials, generally metal or plastic, and are shaped using conventional processes, such as molding or stamping processes. While the present housings can be formed of metal, it is preferable to use moldable plastic of a type that provides good impact resistance, such as high density polyethylene or polypropylene.

The housing can be formed in a single piece, or of multiple pieces and then joined. For example, the housing could be formed in two symmetrical pieces and then joined along the center line. Likewise, the rear end of the housing can be formed integrally or as a separate piece. Preferably such an end cap is sealed to the main housing body, e.g., by gluing or welding. The separate end cap design can be advantageous to allow easier assembly of the pivot contact and gas vent in the housing.

As the flashlight is configured for side-by-side batteries, the housing is adapted to accept such a configuration. As a result, typically the housing will be elongated and generally oval in transverse cross-section, of sufficient size to accept two side-by-side rows of batteries to be inserted. The housing is typically configured with a round opening at the front to which the bezel attaches and through which batteries can be inserted and removed. The back end is closed and a pivot contact is at the inside back of the housing. The front end opening is off-set from the centerline of the end, such that one of the rows of batteries will be generally in-line with the opening, but the other row will not. The pivot contact acts as a lever and provides a current path between the two rows of batteries. Thus, the housing will accept two rows of batteries, with each row containing one or two batteries. The row of batteries that is not in-line with the battery insertion opening can be termed the first row, and the row in-line with the opening can be termed the second row.

To insert the batteries, the housing is preferably held inclined with the back end lower than the front, and with the side having the opening to which the bezel attaches higher than the side away from the opening. The first battery inserted will then drop to the side of the housing away from the opening, and slide to the back end. If the housing is configured to accept a second battery in that same row (the first row), the second battery will drop into place adjacent the first battery. Once the first row of batteries is complete, the next battery inserted will be in the second row, and will slide down to the back end of the housing and contact the pivot contact. If the flashlight is configured to accept a second battery in the second row it will slide down to contact the other battery in that row. Installation of the bezel with the reflector assembly will push the second row of batteries against one arm of the pivot contact, which levers against the first row of batteries forcing that row against an electrical contact at the inside front of the housing.

Pivot Contact

Figure 5:
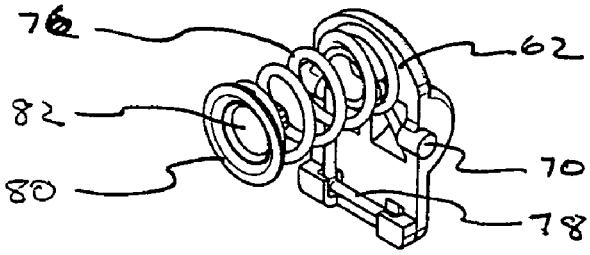
FIG. 5 is an enlarged perspective view of the pivot contact of the exemplary flashlight.
Figure 6:
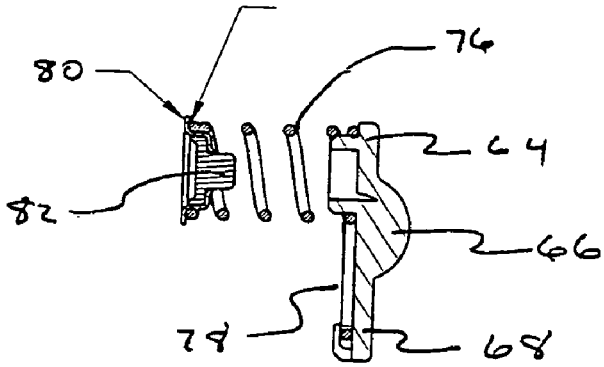
FIG. 6 is an enlarged sectional view of the pivot contact of the exemplary flashlight.
Figure 7:
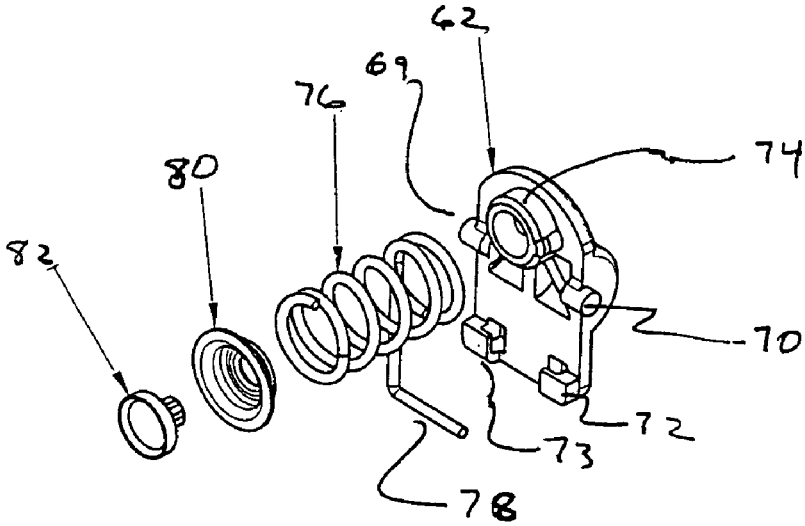
FIG. 7 is an exploded view of the pivot contact of the exemplary flashlight.

As described above, the present invention advantageously uses a pivot contact located in the interior of the housing at the rear end. The pivot contact provides electrical contact between two rows of batteries, while also allowing easy insertion and removal of batteries. The pivot contact is also preferably designed to include battery polarization. As described in more detail below, an exemplary pivot contact is shown in FIGS. 5-7. The pivot contact functions as a lever, which can be configured with unequal length arms. As shown in the Figures, the unequal length arms result from an off-center placement of the pivot point. In the illustrated flashlight, when batteries are installed and the bezel is screwed onto the housing, the pivot contact bears against the inside back wall of the battery housing on the curved pivot or rocker surface.

The unequal length arms result in easier battery insertion and removal. The batteries are easier to insert due to improved clearance for the first row of batteries to be inserted. As described above for the battery housing, to insert batteries, the housing (with bezel removed, is preferably held inclined, with the back of the housing lower than the front. The housing is held with the side of the housing having the front opening up. In this orientation, upon insertion of the first battery, the battery will drop to the lower side of the housing and slide to the back, contacting the long arm of the pivot contact. Whether the the flashlight is configured to accept a second battery in that row or only one battery, sufficient clearance is provided so that the last battery will readily drop into place without additional pressure or manipulation being needed. Similarly, on removal, the provision of such clearance allows the batteries to drop out without the need for further manipulation to release them.

Such clearance is provided because the long arm does not include a spring that will take up the clearance (and preferably has no spring). The short arm of the pivot contact generally is fitted with a spring (preferably on the front (the side toward the front of the housing). Thus, when the second row of batteries is filled, and the bezel with the reflector assembly is attached to the front of the housing, the reflector assembly contacts the first row of batteries, forcing the batteries into the short arm of the pivot contact, thereby pushing the short arm back and levering the long arm forward into the first row of batteries. Because of the unequal length arms, the long arm travels further than the short arm, causing the first row of batteries to against an electrical contact at the front of the housing. Because the long arm travels further than the short arm, ample clearance can be provided for the first row of batteries, resulting in easier battery insertion. The longer travel of the long arm still allows positive contact to be made between the first row of batteries and both the pivot contact and the electrical contact at the front of the housing, despite the provision of enough clearance to allow easy battery insertion and removal.

The capability of the pivot contact to act as a lever, i.e., like a teeter totter, can be provided by a variety of different constructs. Preferably the pivot contact has a curved protrusion on its back that bears against the inside of the back of the housing extending transversly across the contact. The pivot contact then rocks on that protrusion. In other embodiments, the pivot contact is provided by a transverse protrusion on the back of the pivot contact in a different shape, such as trianglular protrusion; the protrusion can be formed in the back end of the housing; the pivot is provided by a hinge, such as opposing hinge pins that extend into matching sockets in the sides of the housing. For any configurations of the pivot contact, preferably the pivot contact and the inside back of the housing are configured such that the back of one arm of the pivot contact bears against the inside back of the housing when the flashlight is assembled with batteries in place. Such a configuration mades the pivot contact more resistant to failure than if all the pressure is place on the pivot point.

As described herein, preferably the flashlight is configured to have battery polarization. Exemplary constructs for accomplishing such polarization are described below. In certain embodiments, the pivot contact includes constructs that participate in that battery polarization. Exemplary constructs are described below in the discussion of battery polarization and with reference to the Figures.

Typically, the lever portion of the pivot contact will be constructed of molded plastic. The electical path can then be provided by a metal piece that provides an electrical path between the negative terminal of the rear-most battery in one row with the positive terminal of the rear-most battery in the other row. The metal piece can conveniently be a coil spring on the long arm of the pivot contact with an extension leg extending to the short arm to contact the other battery row.

Battery Polarization

In order to reduce the risk of battery damage and potential battery explosion, it is advantageous to configure the flashlight to have battery polarization, meaning that completing an electrical circuit to energize the light source will only be possible if the batteries are inserted with correct polarization. For designs using two, three, or four batteries with one or two batteries in each battery row, this can be accomplished using suitable components at the ends of each row of batteries. That is, components can be shaped such that electrical contact will occur if the orientation of the adjacent battery is correct, but not if the orientation is reversed. As an example of how this can be accomplished, if electrical contact is to be made with the positive terminal of a conventional cylindrical battery (such as a AA battery), a central contact is provided, at least partially surrounded by a non-conductive or electrically isolated material that prevents electrical contact with the flat negative terminal of such batteries. Conversly, if contact with the negative terminal is intended, a contact ring or other non-central contact is provided that will contact the flat surface of the negative terminal, but with a central stand-off such that if the positive terminal is contacted, the central stand-off will bear against the protrusion of the postive terminal and hold the adjacent end of the terminal away from the electrical contact ring (or other electrical contact. Other battery polarization costructs can also be utlized.

Bezel and Light Source Assembly

Flashlight bezels are typically formed of plastic, with female threads for attachment to the battery housing. Such bezels can be used in the present invention. In addition, preferably the bezel forms a water-proof seal with the housing. Such a seal can be provided, for example, by an elastomeric O-ring that fits in an annular channel in the housing, preferably behind a threaded portion of the housing that mates with the bezel.

As with many flashlights, the bezel holds a light source assembly, which includes a fitting or socket for a light source and/or a light source, and can also include a reflector. For the present invention, preferably the rear portion of the assembly is configured to contribute to battery polarization. Generally the positive terminal of a battery bears against a central contact (which may be a central contact of a light source) of the assembly. To provide battery polarization, the rear portion of the assembly can be configured to allow electrical contact with a standard positive terminal of a battery, but not with the negative terminal (or the converse). For example, if the central contact is recessed relative to a non-conductive annular ring (or electrically isolated ring), the protrusion on the positive terminal of a standard battery for flashlight use (or other similar uses) can contact the central contact, but the flat negative terminal of the battery will only contact the non-conductive ring. Thus, if a battery is inserted with incorrect orientation, an electrical path will not be created between the battery and such an assembly.

An exemplary flashlight that includes features as discussed above is shown in FIGS. 1-7. FIG. 1 shows a perspective view of the exterior of exemplary flashlight 10, including the bezel 20 at the front end, the battery housing 30, and the end cap 40 at the rear end of the flashlight.

Figure 3:
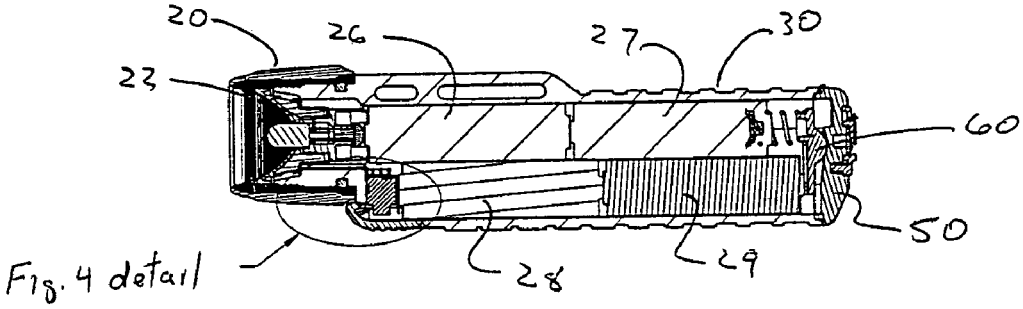
FIG. 3 is a cross-sectional view along the longitudinal axis of the exemplary flashlight.
Figure 4:
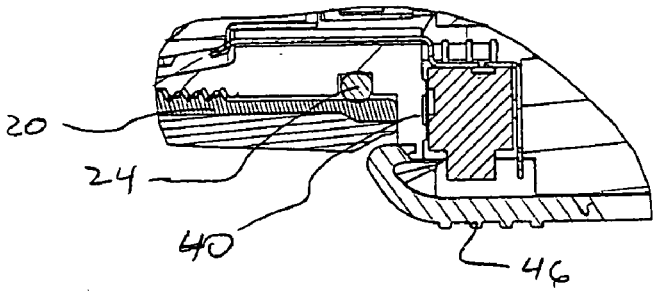
FIG. 4 is an enlarged sectional view of the switch of the exemplary flashlight.
Figure 2:
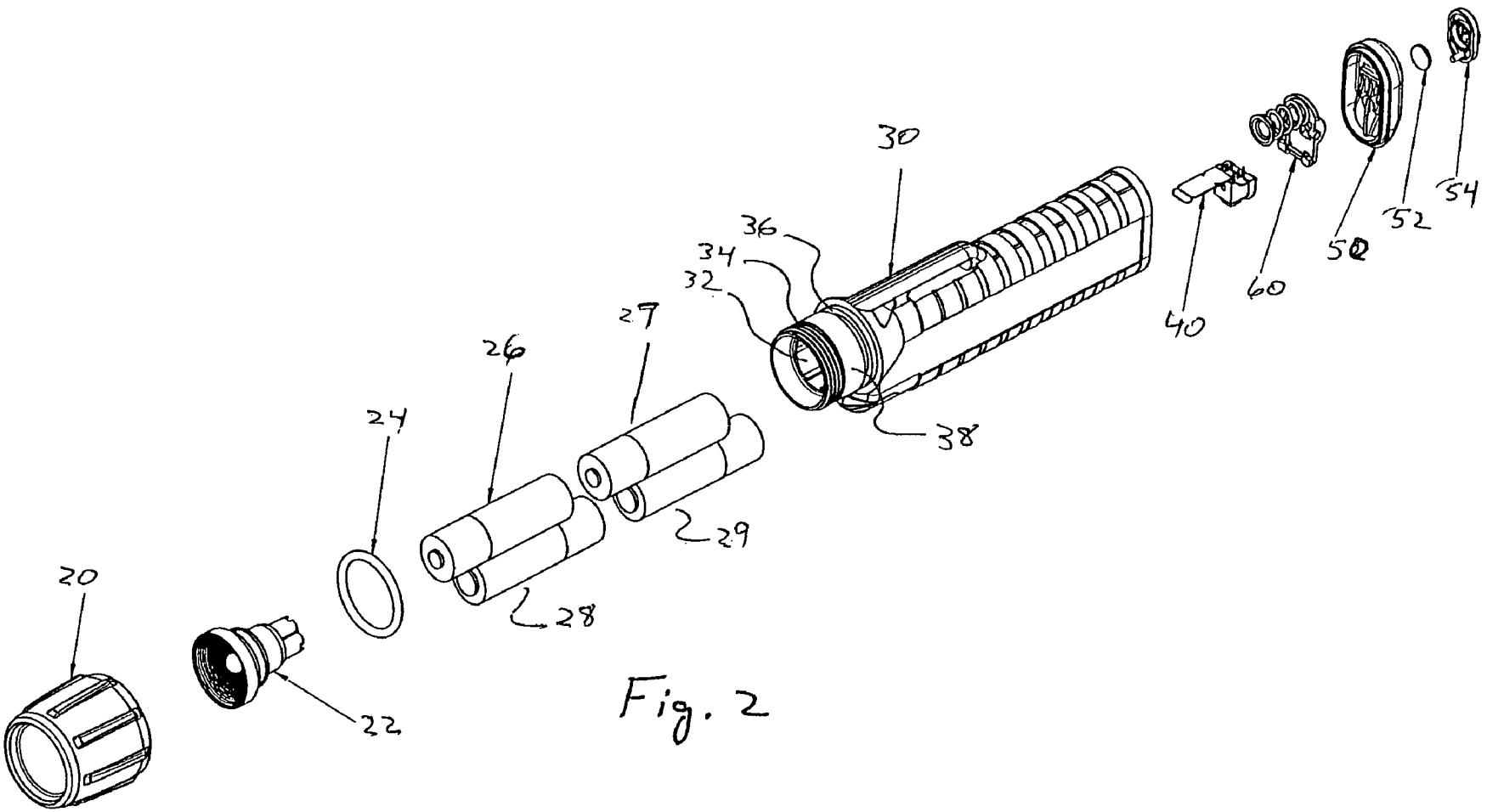
FIG. 2 is an exploded view of the exemplary flashlight.

The construction of the exemplary flashlight 10 is shown in greater detail in the exploded view in FIG. 2. The hollow main battery housing 30 is molded of high impact plastic, and has an opening 32 for insertion and removal of the batteries 26-29. As shown, the exemplary flashlight uses 4 cylindrical batteries, preferably AA size batteries. The front end of the housing 30 is formed as a cylindrical throat, that has male threads 34 that engage the female threads in the bezel 20. The reflector assembly 22 fits in bezel 20. O-ring 24 fits in annular groove 36 and seals against the inside of bezel 20. As shown in FIG. 3, switch assembly 40 fits within the housing 30, with the body of the switch assembly adjacent the throat 38 and the contact extending into the opening 32 within the throat 38.

The rear end of the housing is an end cap 50 that is welded to the main housing 30. The main housing 30 and end cap 40 together will be referred to as the battery housing, or simply housing. Gas venting is provided by a gas permeable/water impermeable PTFE disk 52, that is covered and retained by vent cap 54.

Retained within the housing, agains the end cap is the pivot contact 60. The components of the pivot contact 60 are shown in more detail in FIGS. 5-7. As shown in those figures, the body of the pivot contact is pivot plate 62, which has a pivot curve 66 defining a short arm 64 and a long arm 68. The pivot contact is held in place by locator pins 69 and 70 that fit in matching cavities in main housing 30 and/or end cap 40. Acting as battery contact and tensioning device is coil spring 76. A spring leg 78 extends transversely from the coil portion of the coil spring. The coil spring 76 is retained on the pivot plate with a spring post 74 on which the coil portion of the spring slides, and spring brackets 72 and 73, into which the spring leg 78 fits. At the end of the coil spring distal from the pivot plate, the pivot contact also includes components that contribute to the battery polarization. Polarizing eyelet 80 is soldered to the coil spring 76. Inside the eyelet 80 is the polarizing plug 82. The eyelet 80 provides electrical contact with the negative terminal of battery 27. However, if battery 27 is in the reversed orientation such that the positive terminal contacts the pivot contact, then the protrusion at the positive terminal of battery 27 will contact polarizing plug 82, holding the battery away from polarizing eyelet 80 and preventing an electrical path from being created from battery 27 to pivot contact 60. The spring leg 78 and spring brackets 72 and 73 together provide an electrical path to the first battery row and contribute to battery polarization. When the positive terminal of battery 29 contacts the pivot contact 60, the protrusion of the positive terminal is able to contact spring leg 78 and form an electrical path. However, if the negative terminal of battery 29 contacts pivot contact 60, battery 29 will contact non-conducting spring brackets 72 and 73 and not spring leg 78, so that an electrical path will not be established at that point.

When assembled in the housing, pivot curve 66 rides in a matching depression in the inside surface of the end cap 50.

The construction desribed above is merely exemplary, and does not limit the scope of the invention. For example, other designs for the housing, pivot contact, battery polarization components, and reflector assembly can be used that will function in the present invention.

Unless otherwise defined herein, all terms have the meanings as understood by one of ordinary skill in the art to which the invention pertains. All patents and other references cited in the specification are indicative of the level of skill of those skilled in the art to which the invention pertains, and are incorporated by reference in their entireties, including any tables and figures, to the same extent as if each reference had been incorporated by reference in its entirety individually.

One skilled in the art would readily appreciate that the present invention is well adapted to obtain the ends and advantages mentioned, as well as those inherent therein. The methods, variances, and compositions described herein as presently representative of preferred embodiments are exemplary and are not intended as limitations on the scope of the invention. Changes therein and other uses will occur to those skilled in the art, which are encompassed within the spirit of the invention, are defined by the scope of the claims.

It will be readily apparent to one skilled in the art that varying substitutions and modifications may be made to the invention disclosed herein without departing from the scope and spirit of the invention. For example, the components may constructed of a variety of different suitable materials, various switch mechanisms may be used, the flashlight can be configured for different sizes of batteries such as the common sizes AAA, AA, C, and D, and the pivot contact may be designed in a variety of different ways. Thus, such additional embodiments are within the scope of the present invention and the following claims.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values are provided for embodiments, additional embodiments are described by taking any 2 different values as the endpoints of a range. Such ranges are also within the scope of the described invention.

Thus, additional embodiments are within the scope of the invention and within the following claims.

What is claimed is:

1. A battery housing for a flashlight, said battery housing having a front end, a rear end, and configured to accept a plurality of batteries in a side-by-side configuration of at least a first row of batteries and a second row of batteries, said housing including a pivot contact located at one end of the battery housing, said pivot contact comprising:

a plate comprising a front and a back surface;

an off-center pivot defining a short arm and a long arm of said plate, the short arm being adapted to contact the first row of batteries and the long arm being adapted to contact the second row of batteries; and a conductive material providing an electrical path from a front surface of said short arm to a front surface of said long arm.

2. The battery housing of claim 1, wherein said back surface of said plate is curved.

3. The battery housing of claim 1, wherein at least a portion of said back surfhce not including said pivot is configured to rest against an interior surface of said housing when batteries are installed.

4. The battery housing of claim 1, wherein said conducting material comprises a coil spring extending from the front surface of said short arm.

5. The battery housing of claim 4, wherein said pivot contact further comprises a battery polarizer.

6. The battery housing of claim 5, wherein said battery polarizer comprises a conductive ring for contacting a negative terminal of a battery, and a non-conductive plug in the center of said ring for preventing electrical contact with the positive terminal of a battery.

7. The battery housing of claim 6, wherein said conductive material providing an electrical path from the front surface of said short arm to the front surface of said long arm comprises an arm extending from said spring.

8. A battery housing configured to accept a plurality of batteries in a side-by-side configuration of at least a first row of batteries and a second row of batteries and provide electrical communication therebetween, said housing comprising a pivot contact, said pivot contact comprising:

a plate comprising a front and a back surface;

an off-center pivot defining a short arm and a long arm of said plate, the short arm being adapted to contact the first row of batteries and the long arm being adapted to contact the second row of batteries; and a conductive material providing an electrical path from a front surface of said short arm to a front surface of said long arm;

said pivot contact providing an electrical connection between the first row of batteries and the second row of batteries.

9. The battery housing of claim 8, wherein said back surface of said plate is curved.

10. The battery housing of claim 8, wherein at least a portion of said back surface not including said pivot is configured to rest against an interior surface of said housing when batteries are installed.

11. The battery housing of claim 8, wherein said conducting material comprises a coil spring extending from the front surface of said short arm.

12. The battery housing of claim 11, wherein said pivot contact further comprises a battery polarizer.

13. The battery housing of claim 12, wherein said battery polarizer comprises a conductive ring for contacting a negative terminal of a battery, and a non-conductive plug in the center of said ring for preventing electrical contact with the positive terminal of a battery.

14. The battery housing of claim 13, wherein said conductive material providing an electrical path from the front surface of said short arm to the front surface of said long arm comprises an arm extending from said spring.

* * * * *